United States Patent [19]

Uno et al.

[11] Patent Number: 4,712,741

[45] Date of Patent: Dec. 15, 1987

[54] EXPLOSION PREVENTIVE ROTATION CRUSHER

[75] Inventors: Kunihiko Uno, Hirakata; Yoshinori Tamade, Kobe; Seiya Horino, Miki; Tamotsu Kodera, Otsu, all of Japan

[73] Assignee: Kabushiki Kaisha Takuma, Japan

[21] Appl. No.: 770,363

[22] Filed: Aug. 28, 1985

Related U.S. Application Data

[63] Continuation of Ser. No. 589,447, Mar. 14, 1984, abandoned.

[51] Int. Cl.[4] ..... B02C 25/00

[52] U.S. Cl. ..... 241/16; 241/18; 241/30; 241/31; 241/33; 241/DIG. 14

[58] Field of Search ..... 241/31, DIG. 14, 30, 241/33, 34, 185 R, 15, 16, 18

[56] References Cited

U.S. PATENT DOCUMENTS

| | | | |
|---|---|---|---|
| 1,708,123 | 4/1929 | Day | 241/15 X |
| 2,561,043 | 7/1951 | Ayers | 241/31 |
| 2,565,420 | 8/1951 | Ayers | 241/31 X |
| 4,244,529 | 1/1981 | DeGabriele et al. | 241/31 X |

FOREIGN PATENT DOCUMENTS

| | | | |
|---|---|---|---|
| 1485448 | 9/1977 | United Kingdom | 241/DIG. 14 X |
| 154471 | 10/1963 | U.S.S.R. | 241/31 |

*Primary Examiner*—Mark Rosenbaum

[57] ABSTRACT

The present invention relates to a rotation crusher which treats refuse and seeks to prevent explosions by controlling the volume of steam fed into the crusher to keep the temperature inside a main body of the crusher between about 70° C. to 100° C. so that the steam content may be regulated to exceed a certain value to keep the oxygen content below an explosion preventive critical value, thereby preventing completely explosions inside the crusher.

6 Claims, 6 Drawing Figures

EXPLOSION PREVENTIVE ROTATION CRUSHER

This is a continuation of application Ser. No. 589,447, filed Mar. 14, 1984, now abandoned.

BACKGROUND OF THE INVENTION

The present invention relates to an explosion preventive rotation crusher which crushes into small pieces big-size disused articles such as furniture and the like and non-combustible garbage such as empty cans and bottles and the like.

With development of industries and economies, people have changed their ways of life and refuse from homes and factories has become various in kind and increased in quantity. In big cities home garbage such as left-over foods, waste paper and the like and big-size disused articles (such as furniture) and non-combustible garbage are collected separately. The home garbage is burned in an incinerator. On the other hand, the big-size disused articles and the non-combustible garbage are crushed into small pieces by horizontal axis type or vertical axis type rotation crushers and then are grouped into combustible refuse, metal, glass, and others. The combustible refuse is burned and metal is put to reuse.

Both the horizontal axis type and the vertical axis type rotation crushers which crush big-size disused articles and non-combustible refuse, are so structured that hammers rotate at high speed inside the crushers to strike, sear and grind the big-size articles and non-combustible refuse.

Consequently, in the event that combustible refuse happens to have been mixed in the refuse to be crushed, such as big-size articles and incombustible refuse, a danger of explosions and fires occurs. In fact, explosions frequently occur at refuse treating facilities which dispose of such big-size articles in disused and incombustible refuse.

A known explosion preventive rotation crusher treating big-size disused articles and incombustible refuse is filled with steam, nitrogen gas, $CO_2$ and the like to keep pressure inside the crusher within a predetermined range, thereby making oxygen content almost nil inside the crusher to prevent explosions. Since the crusher is kept pressurized and filled with steam or the like, explosions are prevented even if combustible refuse is mixed in the refuse to be crushed.

But, the above stated rotation crusher still has many disadvantages and problems to be dealt with. For instance, it is very uneconomical that so much steam or the like must be fed into the crusher to keep the crusher at a certain pressurized state. Consequently, in order to solve the problem, it is very important to know exactly the critical oxygen content which can prevent explosions (the explosion preventive critical oxygen content) and further it is also imperative to measure speedily, exactly and easily the distribution of oxygen in the crusher.

SUMMARY OF THE INVENTION

Against the above stated background the present invention is provided on the basis of the results of research on causes of explosions, data analysis, fundamental experiments, experiments using a real apparatus and others, and is concerned with a practical system which prevents explosions efficiently and surely.

It is a first objective of the present invention to provide a rotation crusher which prevents explosions by feeding steam into the crusher wherein consumption of the steam is held at a minimum without undermining the safety of the crusher.

It is a second objective of the present invention to provide a rotation crusher which further improves safety by measuring exactly the explosion preventive critical oxygen contents, oxygen being mixed with the steam or the like and combustibles, and also by measuring quickly, exactly and easily the distribution of oxygen contained in the crusher.

It is necessary for achieving the above stated objectives to check the critical oxygen contents which can prevent explosions, with oxygen being mixed with steam (or the like) and combustibles, and next to study relations between temperatures and oxygen contents inside the crusher. Also, it is necessary to learn a range of the temperatures inside the crusher in operation in which the oxygen contents inside the crusher are below the explosion preventive value. The crusher according to the present invention is structured so that steam fed into the crusher is controlled so that temperatures inside the crusher are kept within the aforegoing range. That is, the present invention which crushes in the steam the refuse such as big-size disused articles, incombustibles and other endeavors to control the volume of the steam fed into the crusher so that the temperatures inside the crusher are kept at about 70° C. to 100° C.

DETAILED DESCRIPTION OF THE INVENTION

Generally speaking, an explosion is a kind of combustion reaction accompanied by production (generation) of gases. Once it starts, it tends to be accelerated in speed as long as there exists something combustible. There are various causes of explosions occurring at facilities treating big-size disused articles and incombustibles. The explosions resulting from petroleum group combustibles (such as petroleum, gasoline, benzine, thinner and others) account for more than 90 of all the explosion accidents. Table 1 shows an example of the causes of explosion accidents at facilities treating big-size articles and incombustibles.

TABLE 1

An Example of Explosion Accidents:

| Substances Which Caused Explosions | Ratio (%) |
|---|---|
| Propane gas containers (Bombe) | 45.5 |
| Petroleum, benzine & thinner | 18.2 |

TABLE 1-continued

| An Example of Explosion Accidents: | |
|---|---|
| Substances Which Caused Explosions | Ratio (%) |
| Alminium powder | 9.1 |
| Chemicals | 9.1 |
| Agricultural medicine | 9.1 |
| Others | 9.1 |

Judging from circumstances surrounding explosion accidents, explosions are inferred to break out as explained below.

When containers such as propane gas containers, petroleum cans, thinner cans, containers holding chemicals and agricultural medicines therein and the like are mixed with big-size disused articles and incombustibles are fed into a crusher, the containers are crushed and destroyed by hammers of the crusher, thereby inducing liquid propane, gasoline and the like to evaporate and further causing the chemicals, the agricultural medicines and the like to turn into mists. The evaporated gasoline, the turned-into-mist chemicals and the like are mixed with air to reach explodable content ratio and are lit by sparks inside the crusher, thereby resulting in explosions.

The present invention is in principle structured for prevention of explosions so that steam fed into the crusher is controlled to regulate temperatures inside the crusher so that the steam content inside the crusher is kept above a predetermined value, thereby keeping oxygen content below the explosion preventive critical value.

Figure 1:
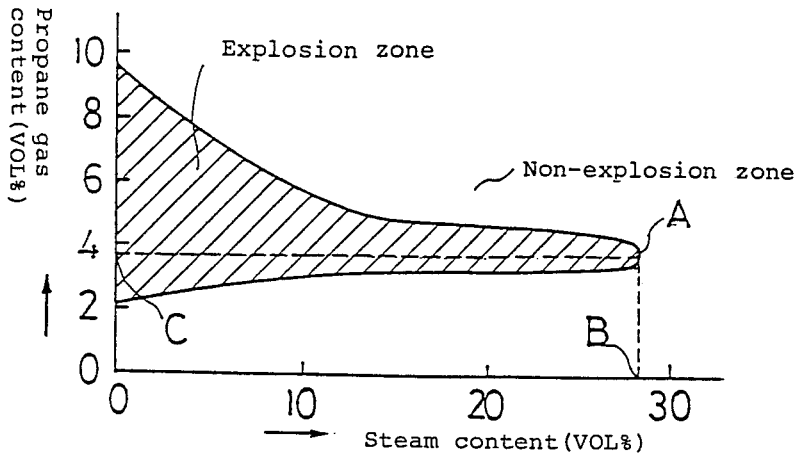
FIG. 1 shows a critical range resulting in explosions (or non-explosions), with propane gas being mixed with air and steam.
Figure 2:
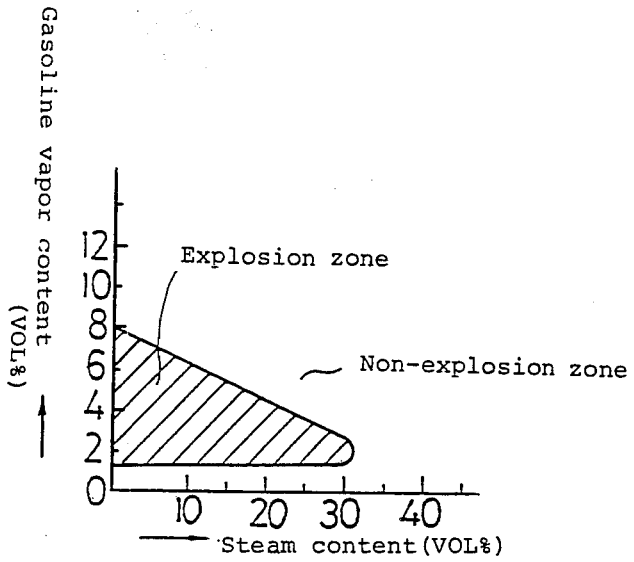
FIG. 2 shows a critical range resulting in explosions (or non-explosions), with gasoline being mixed with air and steam.
Figure 3:
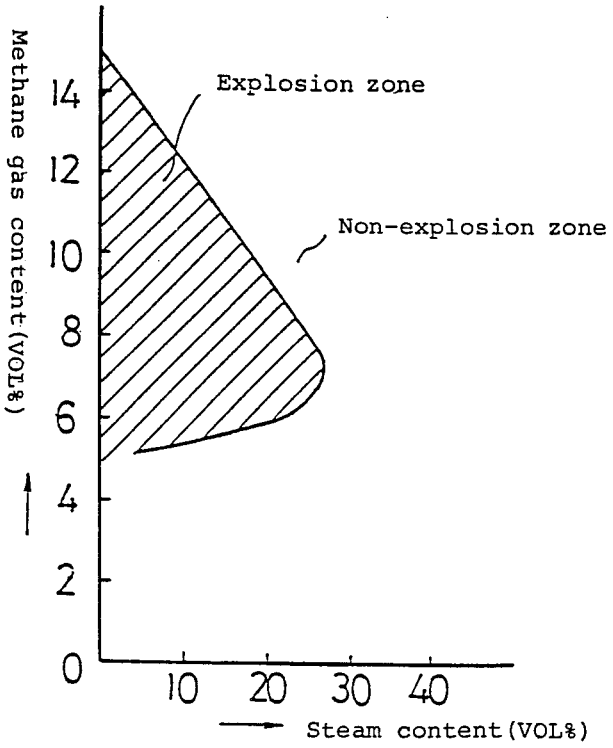
FIG. 3 shows a critical range resulting in explosion (or non-explosions) with methane gas being mixed with air and steam.

FIGS. 1 to 3 show explosion preventive critical values of the combustibles mixed with air and steam. FIG. 1 shows the explosion preventive critical value of propane gas which was learned through experiments, with the propane gas being mixed with air and steam. If the steam content exceeds the point A (which means a reduced oxygen content), explosions do not occur irrespective of the content of propane gas. Consequently, it is necessary for prevention of explosions that a value of oxygen content at point A be calculated so that the oxygen content inside the crusher might be kept below the value as calculated above.

The oxygen content at the point A is calculated according to the following formula:

$$O_2(A)=0.21\times]100\%-(B+C)]$$

Note:

$O_2(A)$: the oxygen content at point A

B: the steam content at point A=29.5

C: the propane gas content at point A=3.5%

Hence, $O_2(A)=0.21\times[100-(29.5+3.5)]=14$ (Vol %)

This shows that propane gas explosions are completely prevented if the oxygen content is kept below 14 Vol % by feeding steam into the crusher.

Further, FIGS. 2 and 3 illustrated on the basis of the experiments show the explosion-preventive critical range (scope) gained when there exist mixtures of gasoline, air and steam, and methane, air and steam, respectively. The critical oxygen content to prevent explosions as calculated in the same manner as in FIG. 1 are 13.9 Vol% and 13.8 Vol% with respect to gasoline (FIG. 2) and methane (FIG. 3), respectively. As a result, gasoline and methane explosions are prevented completely if the oxygen content inside the crusher is controlled below the respective values.

In the same manner, experiments show that explosions of isobutane and benzene are prevented if oxygen content is controlled below 14 Vol% and 13 Vol%, respectively.

Next, turning to a method for controlling the quantity of steam fed into the crusher, widely known is a method in which the oxygen content in the crusher is measured and then a control valve is opened or closed depending upon the oxygen content measured. But, employing the above stated method makes it necessary to measure the oxygen content at many places inside the crusher since the capacity of the crusher is very big and further it is unpredictable where explosions will occur. Consequently, many gauges for measuring the oxygen content are necessary according to the aforegoing method. Since pipes leading to the gauges are easily clogged with crushed articles (refuse), the method has the disadvantage that it is difficult to measure continually and exactly.

The present invention employs a new method in which the steam fed into the crusher is controlled on the basis of temperatures measured inside the crusher so that the steam content at various places in the crusher are kept above a certain value, thereby keeping the oxygen content below the explosion-preventive critical value. In comparison with the above stated method widely used which directly measures the oxygen content, this new method is economical, and superior in that this method can measure the oxygen content minutely and simultaneously at desired places and can increase easily the number of the places where the oxygen contents are measured. As for the method of measuring the temperatures, thermometers can possibly be inserted inside the crusher. But, the thermometer inserting method has a disadvantage that the thermometers inserted into the crusher might be hit and broken by articles crushed in the crusher. Another method which might be employed instead is one in which the temperatures inside the crusher are estimated on the basis of temperatures of the surface of the casing of the crusher.

Figure 4:
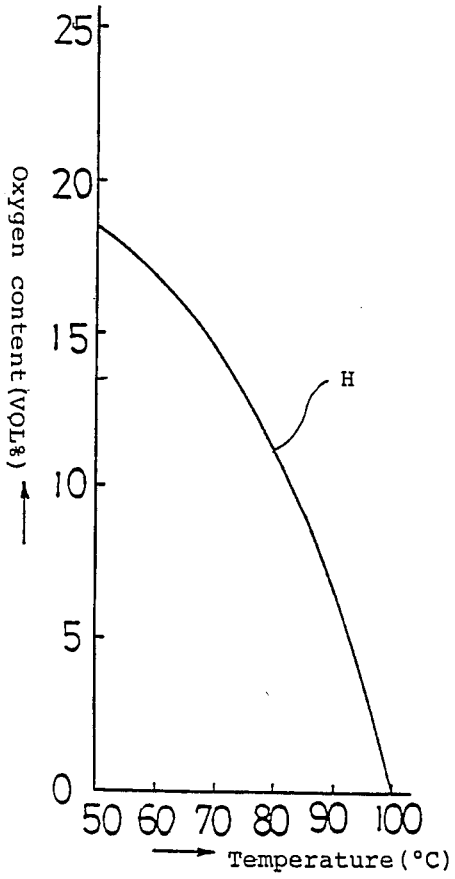
FIG. 4 shows relations between temperatures, relative humidity and oxygen content.

FIG. 4 shows relations between temperatures, the relative humidity and oxygen contents, in which the horizontal axis indicates ambient temperatures, the vertical axis indicates the oxygen content in the ambient air and H indicates a curve showing the relative humidity of 100%. It is known that the steam content in atmosphere is kept at a certain value by the saturation vapor pressure under conditions of perfect mixing, atmospheric pressure and steam saturation. It is noted that gases inside the crusher always stay mixed by rotation of the hammers and that steam saturation or steam supersaturation can be maintained inside the crusher if atmospheric pressure is maintained inside the crusher by feeding into the crusher a required volume of the low-pressurized steam. Consequently, if the temperature is kept at 70° C. to 100° C. inside the crusher, the oxygen content remains below 14 Vol% as shown in FIG. 4, thereby preventing propane gas explosions. The temperatures should be maintained at 75° C. inside the crusher if it is planned to prevent also explosions of gasoline, methane, isobutane and benzene so that oxygen content might be maintained below 13 Vo.%, thereby preventing explosions with more certainty.

As explained above, unnecessary steam consumption is saved by measuring the temperatures inside the crusher with the result that it becomes possible to control the quantity of the fed steam in accordance with heat loss caused by radiation, steam exhaustion and discharging the crushed articles, thereby lessening substantially the steam consumption in comparison with the conventional crusher.

Fundamental experiments and experiments using a real apparatus show that the steam is preferably fed into the crusher at the windward side of ventilation for improved explosion preventive effect, that is, a better effect to lower oxygen content. Consequently, it is advised that the capacity and the number of steam injecting nozzles be increased at the windward side and lessened at the leeward side.

Next, the structure of the crusher according to the present invention is explained with reference to FIG. 5.

Figure 5:
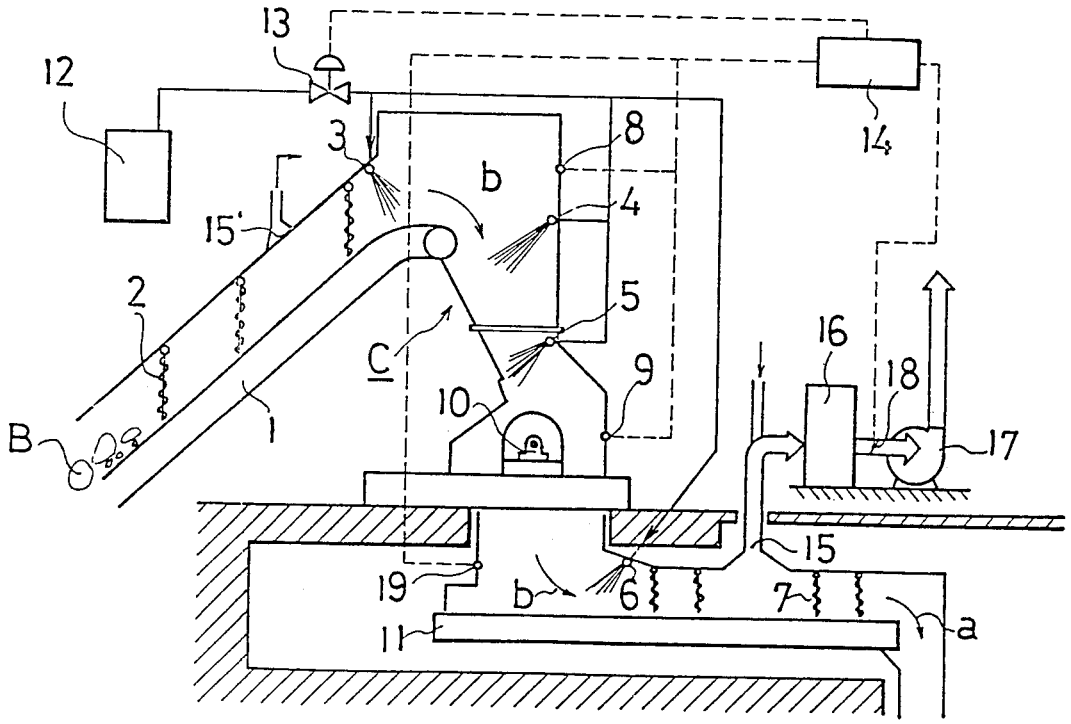
FIG. 5 shows a flow-sheet illustrating an embodiment of an explosion preventive rotation crusher according to the present invention; and, FIG. 6 shows a sample of the oxygen content measured inside a crusher in operation.

FIG. 5 illustrates a flow sheet of an embodiment of the explosion preventive rotation crusher. A main body C of the crusher has a rotation type crushing apparatus 10 inside a box C'. The refuse B such as big-size disused articles, incombustibles and others is conveyed into the main body C by an apron conveyor 1. A curtain(s) 2 and a steam blowing nozzle 3 are positioned over the conveyor 1 to prevent air current. The refuse B is conveyed under the curtain(s) 2. The curtain 2 helps in blocking substantial leakage of the steam. Steam blowing nozzles may be provided at places 3, 4, and 5 as the case may require. The steam blown from the nozzles fills the main body C of the crusher, thereby lowering the oxygen contents.

The crushing apparatus 10 may be of the horizontal axis type or of the vertical axis type. The hammer of the crushing apparatus 10 rotates to crush the refuse by striking, searing and grinding force in cooperation with a fixed blade. A discharging apparatus 11 is provided under the main body C and conveys the crushed refuse to an exit a.

The discharging apparatus 11 may be a vibrating feeder, an apron conveyor or the like. A curtain(s) 7 and, if necessary, the steam blowing nozzles 6 are provided to block air current, thereby allowing the main body to be filled with the steam by preventing steam leakage. The steam is supplied by a steam generating apparatus 12 to the steam blowing nozzles 3 to 6 through a valve 13. It is noted that since ventilation flows in a direction indicated by an arrow b, the number of the nozzles 3 are more at the windward than at the leeward, as stated above (FIG. 5). The quantity of the steam to be supplied is controlled by opening or closing the valve 13 activated by signals transmitted from temperature regulating apparatus 14 and is so regulated that the temperature inside the main body C of the crusher stands at within a predetermined range (about 70° C. to 100° C.). That is, the temperatures inside the main body are measured by therometers 8, 9, 19 and others. On the basis of the temperatures as measured above, the oxygen content inside the main body C are measured by means of the relationship between the temperatures, the relative humidity and the oxygen content as shown in FIG. 4. The oxygen content as measured above are watched and so regulated that the oxygen content may be maintained below the explosion preventive critical value. All the steam blowing nozzles 3, 4, 5, and 6 are not necessarily open together. Some might be open while the others might be closed, depending upon the situations of the main body C of the crusher.

Part of the steam insdie the main body C of the crusher is exhausted through a gas outlet 15 (and, if necessary, through a dust collecting apparatus 16) to the atmosphere by an exhaust fan 17. The volume of the exhaust steam is controlled, depending upon the oxygen content, dust and others inside the main body C, by regulating a damper 18 activated by signals transmitted from the temperature regulating apparatus 14. Also, the gas outlet may be positioned instead, when necessary, at a place designated 15' over the apron conveyor 1.

The position and the number of the current preventive curtains 2 and 7 are determined according to the situation of the crusher. The curtains 2 and 7 may be made, in inseparable (integral) body, of bendable materials such as synthetic resin, rubber and the like, or verticaly long plates (made of stainless steel, aluminum, steel and the like) stitched together in series (just like a blinder).

It is noted that anything can be employed instead of the curtains 2 and 7 as far as it can function to substantially block the gas current but allow the refuse to pass.

Figure 6:
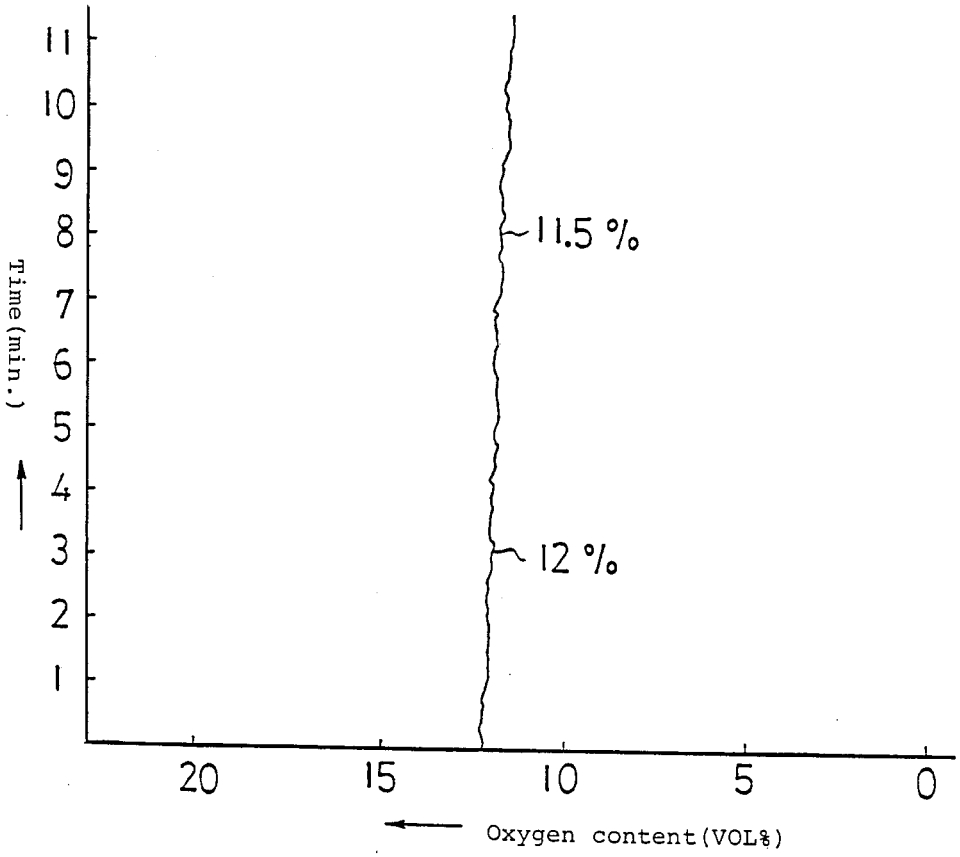

FIG. 6 shows an example indicating data relating to oxygen content inside the main body of the crusher, said data being obtained through experiments using a real crusher. The inventors confirmed at the time of the experiments, by employing oxygen content gauges at the same time, that it is possible to regulate exactly the oxygen content inside the crusher by means of temperatures.

TABLE 2

Temperature Data at the Time of Experiments Employing a Practical (real) Crusher:

| Measuring Place | Ref. No. in FIG. 5 | Temperature |
|---|---|---|
| Feeding shoot | 8 | about 80° C.-85° C. |
| Crushing apparatus | 9 | about 75° C.-80° C. |
| Discharging shoot | 19 | about 75° C.-80° C. |

Table 2 shows that if temperatures inside the crusher are controlled to stand over 75° C., the oxygen contents are automatically regulated to stand below 11.5 Vol% to 12 Vol%, thereby preventing explosions of propane gas, butane gas, gasoline, methane, benzene and others.

Relationship between the values shown on Table 2 and the oxygen content of FIG. 6 correspond exactly to the relationships (FIG. 4) between the temperature, relative humidity and oxygen content. Hence, explosions are prevented without fail if steam is fed into the main body C of the crusher in such a manner that the temperatures inside the crusher are controlled to stand at about 70° C. to 100° C.

The present invention can, as stated above, prevent explosions surely and economically without feeding excessive steam, thereby facilitating substantially lower operating cost and a saving of energy.

Further, since the present invention seeks to regulate the volume of fed steam by means of temperatures measured inside the main body C of the crusher, it has advantages over conventional crushers in that maintenance of the measuring apparatus is easy, succesive measurements at many places is possible with ease and explosion prevention is practiced with high precision.

We claim:

1. In a crushing process at a temperature, absent the injection of steam, below 100° C., for crushing materials including combustible substances in which steam is injected to limit the amount of oxygen in said crushing process to thereby eliminate the possibility of explosions, the additional improvement steps comprising:

(a) determining the amount of steam necessary to prevent an explosion in accordance with the graphs illustrated in FIGS. 1 through 3;

(b) deriving from the determination made in step (a) a corresponding minimum amount of oxygen below which none of the combustible substances could tend, together with any oxygen in said crushing process, to cause an explosion;

(c) measuring the temperature of said crushing process at a plurality of locations to establish by the measured temperature the amount of steam present in said crushing process and thereby also establishing the amount of oxygen present in said crushing process; and (d) injecting, in response to the temperature as measured, no more steam than is required to keep the temperature of the crushing process at a level that assures that the oxygen content, illustrated as a function of temperature in FIG. 4, does not exceed the value necessary to sustain an explosion.

2. The method of claim 1 in which the injection of steam is performed at a plurality of locations within said crushing process.

3. The method of claim 1 further comprising the additional step of performing the crushing process at atmospheric pressure.

4. The method according to claim 1 in which the steam content necessary to prevent explosions when only propane gas is the combustible substance in the crushing process is determined in accordance with the graph illustrated in FIG. 1.

5. The method according to claim 1 in which the steam content necessary to prevent explosions when only gasoline vapor is the combustible substance in the crushing process is determined in accordance with the graph illustrated in FIG. 2.

6. The method according to claim 1 in which the steam content necessary to prevent explosions when only methane gas is the combustible substance in the crushing process is determined in accordance with the graph illustrated in FIG. 3.

* * * * *